US008909102B2

(12) United States Patent
Morgan

(10) Patent No.: US 8,909,102 B2
(45) Date of Patent: Dec. 9, 2014

(54) ELECTROPHOTOGRAPHIC DRUM GEAR FLANGE SOCKET CONFIGURATIONS

(71) Applicant: Clover Technologies Group, LLC, Ottawa, IL (US)

(72) Inventor: John Morgan, Newbury Park, CA (US)

(73) Assignee: Clover Technologies Group, LLP, Ottawa, IL (US)

( * ) Notice: Subject to any disclaimer, the term of this patent is extended or adjusted under 35 U.S.C. 154(b) by 0 days.

(21) Appl. No.: 14/068,569

(22) Filed: Oct. 31, 2013

(65) Prior Publication Data

US 2014/0119778 A1 May 1, 2014

Related U.S. Application Data

(60) Provisional application No. 61/720,740, filed on Oct. 31, 2012.

(51) Int. Cl.

*G03G 15/00* (2006.01)
*G03G 21/16* (2006.01)
*G03G 15/08* (2006.01)

(52) U.S. Cl.

CPC ..... *G03G 15/0865* (2013.01); *G03G 21/1647* (2013.01)
USPC ..... 399/167

(58) Field of Classification Search

CPC ..... G03G 15/757
USPC ..... 399/167
See application file for complete search history.

(56) References Cited

U.S. PATENT DOCUMENTS

| | | | | |
|---|---|---|---|---|
| 7,885,575 | B2 | 2/2011 | Batori et al. | |
| 8,644,732 | B2 * | 2/2014 | Kikuchi et al. | 399/117 |
| 8,676,090 | B1 * | 3/2014 | Ueno et al. | 399/167 |
| 2011/0318054 | A1 * | 12/2011 | Fukuzawa et al. | 399/117 |
| 2012/0051787 | A1 * | 3/2012 | Lui | 399/167 |
| 2012/0183331 | A1 * | 7/2012 | Huang et al. | 399/167 |
| 2013/0230337 | A1 * | 9/2013 | Batori et al. | 399/117 |
| 2013/0322924 | A1 * | 12/2013 | Kondo et al. | 399/167 |
| 2014/0119778 | A1 * | 5/2014 | Morgan | 399/167 |

* cited by examiner

*Primary Examiner* — W B Perkey
(74) *Attorney, Agent, or Firm* — Mathew G. Gavronski

(57) ABSTRACT

A toner drum gear flange socket adapted for engagement with a force transmitting end of a drive shaft in an electrophotographic image forming apparatus. The socket includes a bottom wall and an outer cylindrical wall including an inner surface and defining a central axis. Circumferentially spaced apart curved base wall portions extend axially from the bottom wall. Each base wall portion includes an enlarged end portion that defines a radially inwardly extending projection. A leg wall portion extends radially from one end of each curved base wall portion. Each leg wall portion defines an elongated contact surface. The radially inwardly extending projections secure the force transmitting end of the drive shaft within the socket, and the elongated contact surfaces receive driving rotational force from the force transmitting end of the drive shaft.

14 Claims, 6 Drawing Sheets

ELECTROPHOTOGRAPHIC DRUM GEAR FLANGE SOCKET CONFIGURATIONS

CROSS-REFERENCE TO RELATED APPLICATION

This application claims the benefit of and priority to U.S. Provisional Patent Application No. 61/720,740, filed Oct. 31, 2012, the entire contents of which are hereby incorporated by reference herein.

BACKGROUND

When a toner cartridge for a laser printer is installed in a printer, a variety of mechanical and electrical connections can be made between the toner cartridge and the printer. Among the connections is a driving mechanical connection between a drive gear on the printer and a driven gear provided on one end of a toner drum in the toner cartridge. Different makes and models of printers can include mechanical and electrical connections in different configurations. For example, one line of printers utilizes an elongated drive shaft having a force receiving end provided with recesses for engagement with projections in the printer, and a force transmitting end in the form of a generally spherical ball. A pin extends generally through the center of the ball and is configured for engagement with a socket connection provided on a gear flange that is coupled to the end of the toner drum in the toner cartridge. This configuration is described in further detail in U.S. Pat. No. 7,885,575, the entire contents of which are hereby incorporated by reference herein. For proper operation of aftermarket or replacement toner cartridges in that line of printers, the gear flange of the replacement toner cartridge should include a socket connection that is able to receive driving rotatable force from the pin while also securely engaging the ball so the drive shaft remains securely coupled to the gear flange during transportation and installation of the replacement toner cartridge.

SUMMARY

In some aspects, a toner drum gear flange socket is provided. The socket may be adapted for engagement with a force transmitting end of a drive shaft associated with an electrophotographic image forming apparatus. The socket includes a bottom wall and an outer cylindrical wall including an inner surface and defining a central axis. The outer cylindrical wall extends axially from the bottom wall and cooperates therewith to define a flange cavity. The socket also includes a plurality of circumferentially spaced apart curved base wall portions extending axially from the bottom wall. Each base wall portion has the central axis as its axis of curvature, and includes an enlarged end portion that defines a radially inwardly extending projection. A plurality of substantially straight leg wall portions extends axially from the bottom wall. Each leg wall portion also extends generally radially from one end of a respective one of the curved base wall portions and defines an elongated contact surface for receiving driving rotational force from the force transmitting end of the drive shaft.

A radially outer end of each leg wall portion may be inwardly spaced from the inner surface of the outer cylindrical wall. A respective leg wall portion may be positioned at each end of each base wall portion. The leg wall portions and the base wall portions may be arranged to define a plurality of circumferentially spaced apart and substantially U-shaped walls, where each U-shaped wall includes one of the base wall portions and two of the leg wall portions. A radially outer end of each leg wall portion may be inwardly spaced from the inner surface of the outer cylindrical wall. The substantially U-shaped walls may be arranged in substantially diametrically opposed pairs. The leg wall portions and the base wall portions may be connected to the outer cylindrical wall exclusively by way of the bottom wall.

In other aspects, a toner drum gear flange socket is provided. The socket may be adapted for engagement with a force transmitting end of a drive shaft associated with an electrophotographic image forming apparatus. The socket includes a bottom wall and an outer cylindrical wall including an inner surface and defining a central axis. The outer cylindrical wall extends axially from the bottom wall and cooperates therewith to define a flange cavity. The socket also includes a plurality of circumferentially spaced apart curved base wall portions extending axially from the bottom wall. Each base wall portion has the central axis as its axis of curvature, and includes an enlarged end portion that defines a radially inwardly extending projection.

The base wall portions may comprise inner arcuate walls, and the socket may further include a plurality of outer arcuate walls positioned between the base wall portions and the outer cylindrical wall. Each outer arcuate wall may be substantially radially aligned with a respective one of the inner arcuate walls to define an arcuate wall pair. The inner arcuate wall and the outer arcuate wall of each arcuate wall pair may include substantially parallel end surfaces that cooperate to define an engagement surface for receiving driving rotational force from the force transmitting end of the drive shaft. Each outer arcuate wall may have the central axis as its axis of curvature. The inner arcuate walls and the outer arcuate walls may be connected to the outer cylindrical wall exclusively by way of the bottom wall.

Figure 1:
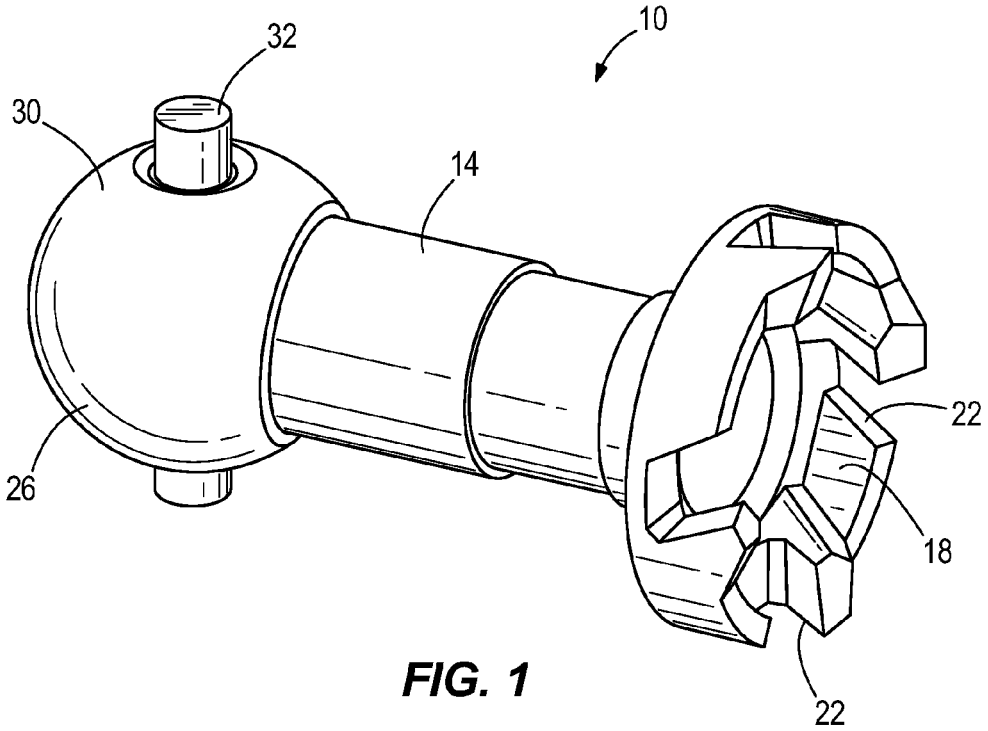
FIG. 1 is a perspective view of a drive shaft for a toner drum in an electrophotographic image forming device.

While the subject matter of this disclosure can be practiced and carried out in many different ways, certain embodiments are shown in the drawings and described in detail with the understanding that such drawings and description are exemplary in nature and are not intended to limit the scope of the invention set forth in claims only to those embodiments that are illustrated and described.

DETAILED DESCRIPTION

FIG. 1 illustrates a drive shaft 10 used in certain types of electrophotographic image forming apparatus. The drive shaft 10 includes a central shaft 14, a force receiving end 18 including a plurality of recesses 22 adapted to receiving driving force from a drive system (not shown) provided on the image forming apparatus, and a force transmitting end 26 opposite the force receiving end 18. The force transmitting end 26 includes a generally spherical ball portion 30, and a pin member 32 that extends generally through the center of the ball portion 30. The drive shaft 10 is configured to transmit driving rotational force from the drive system of the image forming apparatus to a toner drum (not shown) in a toner cartridge to rotate the toner drum during operation.

FIGS. 2, 4, 6, 8, 10 illustrate five toner cartridge drum gear flanges 34*a*, 34*b*, 34*c*, 34*d*, and 34*e*, each having a unique interior engagement configuration adapted for engagement with the force transmitting end 26 of the drive shaft 10. Each gear flange 34*a*, 34*b*, 34*c*, 34*d*, and 34*e* includes a bottom wall 36 and a generally cylindrical outer wall 38 including an inner surface 39 and defining a central axis 40. The outer wall 38 of each gear flange 34*a*, 34*b*, 34*c*, 34*d*, and 34*e* extends axially from the respective bottom wall 36 and cooperates with the bottom wall 36 to define a flange cavity 42. The flange cavities 42 are each sized to receive the ball portion 30 and pin member 32 of the drive shaft 10. Within each cavity 42 there is provided an arrangement of walls and projections that cooperate to define the unique interior engagement configuration for receiving driving rotational force from the force transmitting end 26 of the drive shaft 10. The interior engagement configurations are individually described below in further detail.

Figure 2:
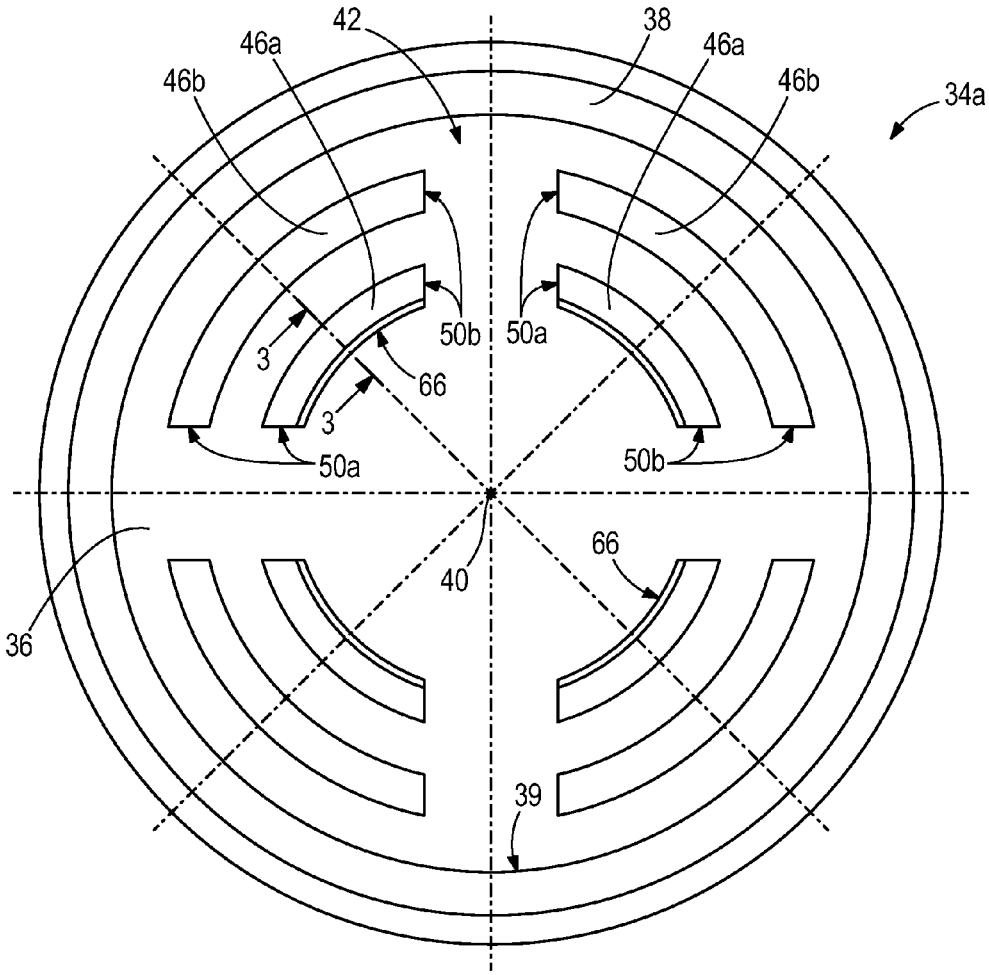
FIG. 2 is an end view of a first drum gear flange configured for coupling with the drive shaft of FIG. 1.

Referring to FIG. 2, the gear flange 34*a* includes an interior engagement configuration defined by four inner arcuate walls 46*a* and four outer arcuate walls 46*b*, where the inner and outer arcuate walls 46*a*, 46*b* extend in a generally circumferential direction and are arranged in substantially radially aligned pairs. Although not required, in the illustrated configuration, the inner and outer arcuate walls 46*a*, 46*b* all have centers of curvature substantially aligned with the central axis 40. Each inner wall 46*a* and each outer wall 46*b* includes substantially flat first and second end surfaces 50*a*, 50*b*, and for each pair of walls 46*a*, 46*b*, the first end surface 50*a* of the inner wall 46*a* is substantially co-planar with the first end surface 50*a* of the outer wall 46*b*, and the second end surface 50*b* of the inner wall 46*a* is also substantially co-planar with the second end surface 50*b* of the outer wall 46*b*. The substantially co-planar end surfaces 50*a*, 50*b* cooperate to define an engagement surface that is contacted by the pin member 32 when the force transmitting end 26 of the drive shaft 10 is received by the gear flange 34*a* and rotated by the drive system of the imagine forming apparatus. In this regard, the pin member 32 contacts the co-planar end surfaces 50*a*, 50*b* to transmit driving rotational force to the gear flange 34*a*.

Figure 3:
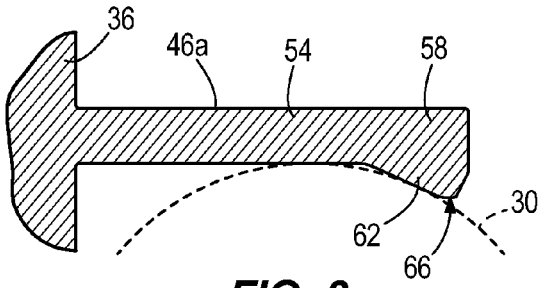
FIG. 3 is a section view taken along line 3-3 of FIG. 2.

Referring also to FIG. 3, each inner wall 46*a* includes an elongated arm portion 54 and an enlarged end portion 58. The enlarged end portions 58 each define a radially inwardly extending projection 62. The projections 62 are configured such that a distance between radially inner surfaces 66 of diametrically opposed projections 62 is less than a diameter of the ball portion 30 of the drive shaft 10. In this way, the ball portion 30 is coupled to the gear flange 34 by inserting the ball portion 30 into the cavity 42 between the inwardly extending projections 62 of the inner walls 46*a*. As the ball portion 30 is inserted, the arm portions 54 of the inner walls 46*a* deflect radially outwardly until the outer diameter of the ball moves beyond the radially inner surfaces 66 of the projections 62 and the ball portion 30 snaps into engagement with the inner walls 46*a*. Thereafter, the projections 62 and the stiffness of the inner walls 46*a* secure the ball portion 30 within the cavity 42, as shown in phantom in FIG. 3. The ball portion 30 subsequently can be removed by applying sufficient axial force on the drive shaft 10 to pull the ball portion 30 out from between the projections 62.

Figure 4:
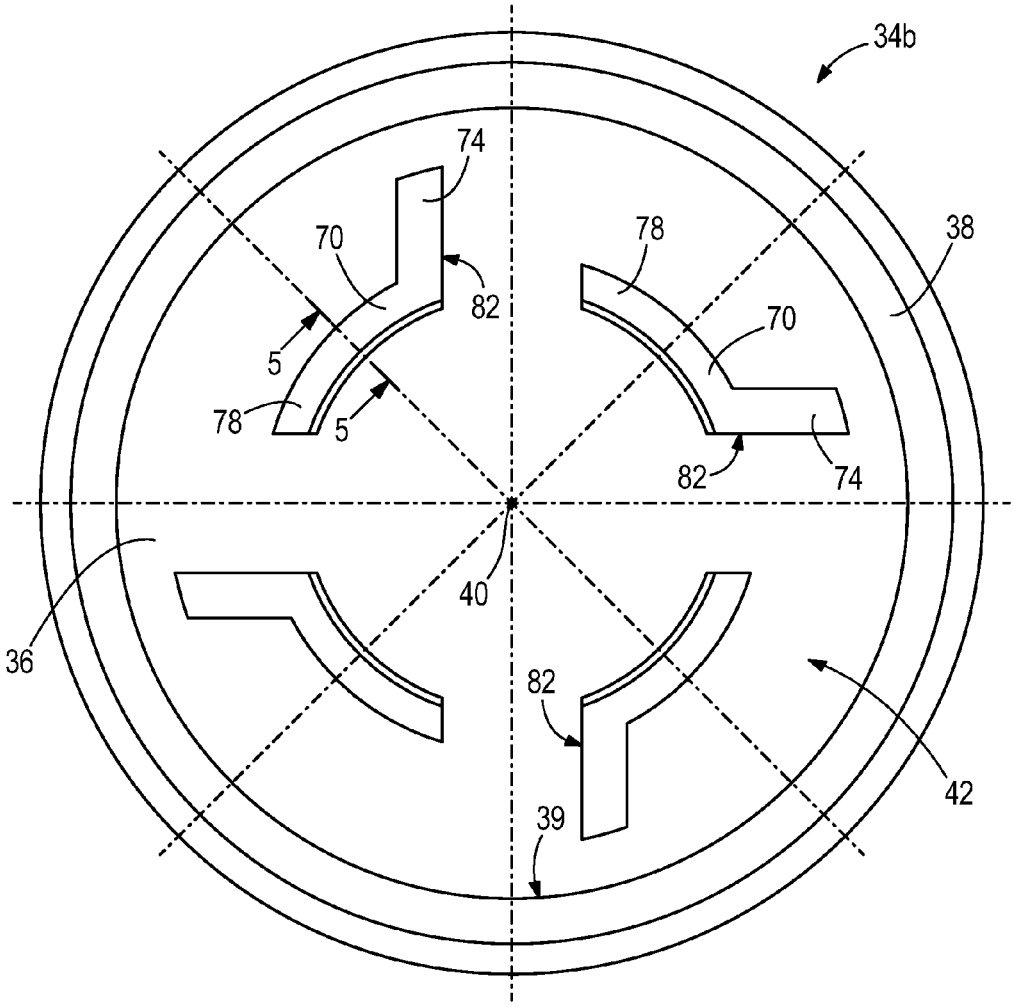
FIG. 4 is an end view of a second drum gear flange configured for coupling with the drive shaft of FIG. 1.
Figure 5:
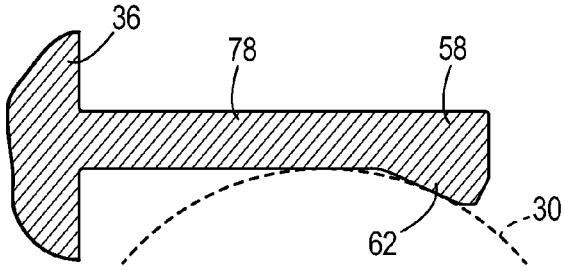
FIG. 5 is a section view taken along line 5-5 of FIG. 4.

Referring also to FIGS. 4 and 5, the drum gear flange 34*b* includes an alternative interior engagement configuration defined by four circumferentially spaced apart and substantially L-shaped walls 70. Each L-shaped wall 70 includes a substantially straight first leg portion 74 and a curved or arcuate second leg portion 78. The straight leg portions 74 each define a substantially planar and elongated contact surface 82 positioned for engagement with the pin member 32 to receive driving rotational force therefrom. In the illustrated configuration, the orientation of the L-shaped walls 70 is such that the drum gear flange 34*b* is adapted to receive driving rotational force from the pin member 32 primarily in a manner that rotates the drum gear flange 34*b* in the counter-clockwise direction as viewed in FIG. 4. As shown in FIG. 5, the curved second leg portions 78 each include an enlarged end portion 58 that defines a radially inwardly extending projection 62. The end portions 58 and projections 62 of the drum gear flange 34*b* function similar to those described with respect to the drum gear flange 34*a*, and provide a snap fit engagement for the ball portion 30 of the drive shaft 10.

Figure 6:
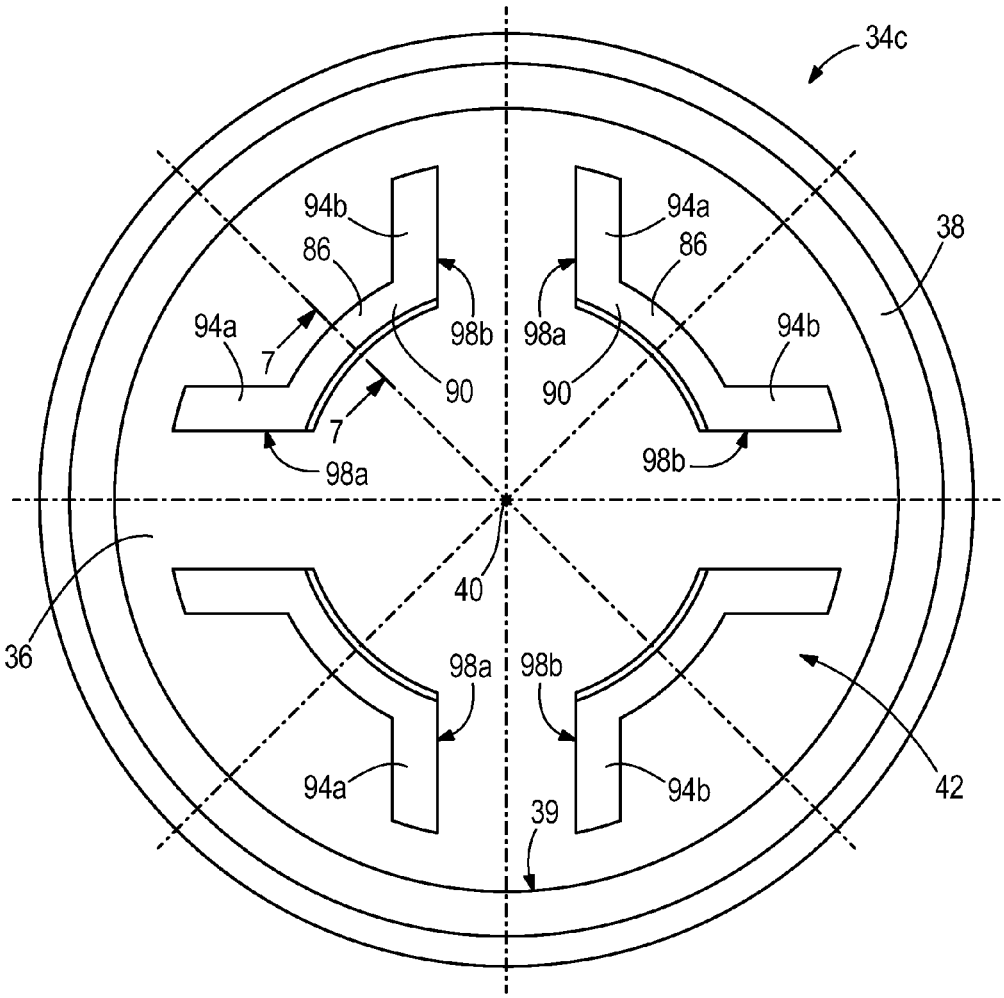
FIG. 6 is an end view of a third drum gear flange configured for coupling with the drive shaft of FIG. 1.
Figure 7:
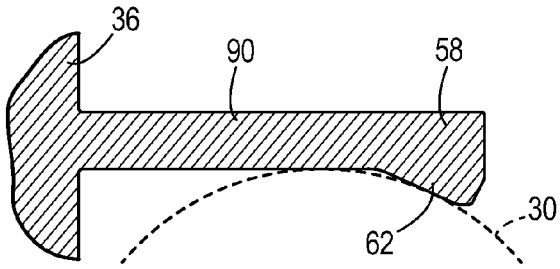
FIG. 7 is a section view taken along line 7-7 of FIG. 6.

Referring also to FIGS. 6 and 7, the drum gear flange 34*c* includes an alternative interior engagement configuration defined by four circumferentially spaced apart and substantially U-shaped walls 86. Each U-shaped wall 86 includes a curved base portion 90 and a pair of substantially straight leg portions 94*a*, 94*b* extending from each end of the base portion 90. As shown, and like the arcuate walls 46*a* of FIG. 2, each curved base portion has a center of curvature substantially aligned with the central axis 40. The straight leg portions 94*a*, 94*b* each define respective elongated contact surfaces 98*a*, 98*b* that are positioned for engagement with the pin member 32 to receive driving rotational force therefrom. The drum gear flange 34*c* is configured to receive driving rotational force from the pin member 32 in either direction. For example, during rotation of the drum gear flange 34*c* in the clockwise direction, the pin member 32 engages the contact surfaces 98*a*, and during rotation of the drum gear flange 34*c* in the counter-clockwise direction, the pin member 32 engages the contact surfaces 98*b*. As shown in FIG. 7, the curved base portions 90 each include an enlarged end portion 58 that defines a radially inwardly extending projection 62. The end portions 58 and projections 62 of the drum gear flange 34*c* function similar to those described with respect to the drum gear flange 34*a*, and provide a snap fit engagement for the ball portion 30 of the drive shaft 10.

Figure 8:
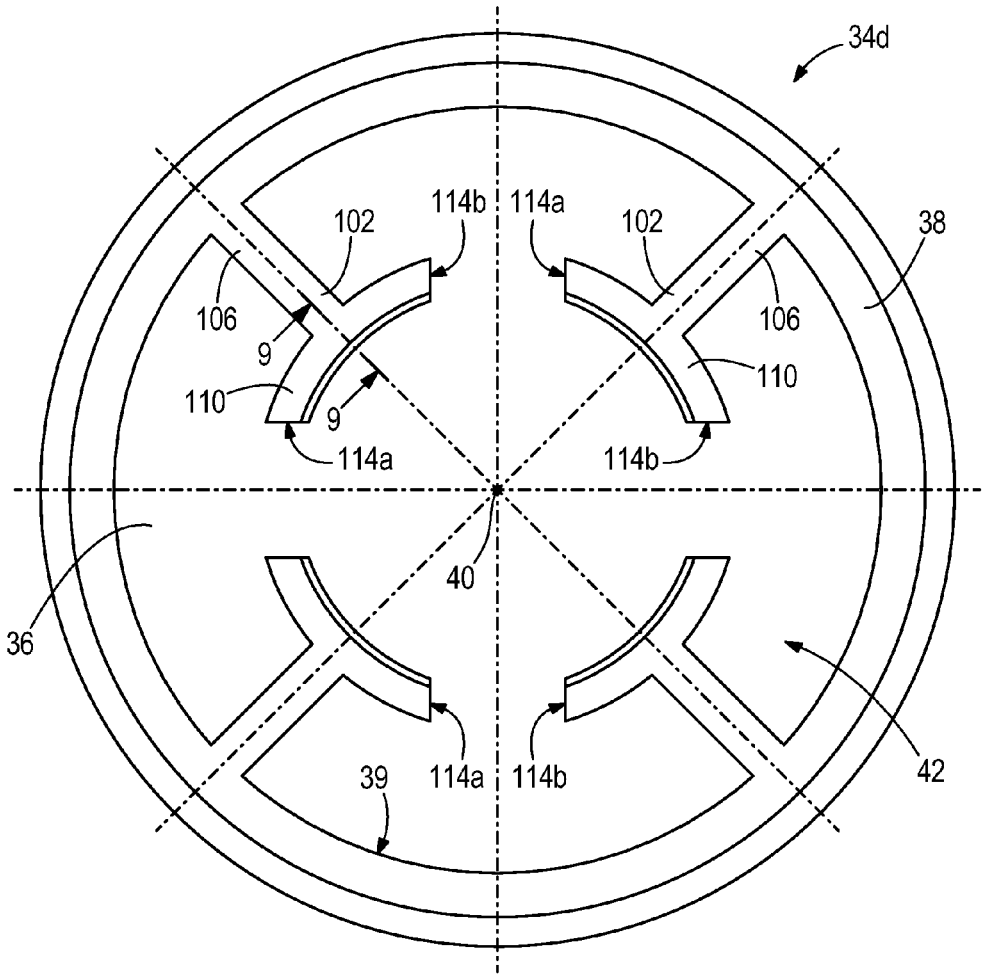
FIG. 8 is an end view of a fourth drum gear flange configured for coupling with the drive shaft of FIG. 1.
Figure 9:
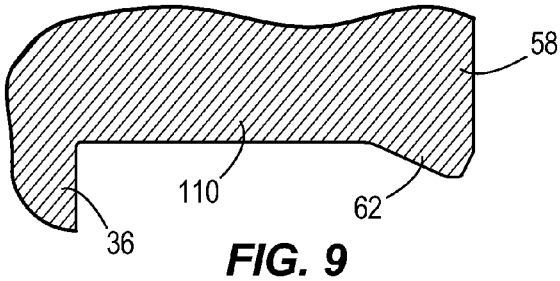
FIG. 9 is a section view taken along line 9-9 of FIG. 8.

Referring also to FIGS. 8 and 9, the drum gear flange 34*d* includes an alternative interior engagement configuration defined by four circumferentially spaced apart and substantially T-shaped walls 102. Each T-shaped wall 102 includes a generally radially extending base portion 106, and a generally circumferentially extending cross portion 110. Each cross portion 110 includes substantially flat first and second end surfaces 114*a*, 114*b* that define engagement surfaces for receiving driving rotatable force from the pin member 32. During rotation of the drum gear flange 34*d* in the clockwise direction, the pin member 32 engages the contact surfaces 114*a*, and during rotation of the drum gear flange 34*d* in the counter-clockwise direction, the pin member 32 engages the contact surfaces 114*b*. As shown in FIG. 9, the circumferentially extending cross portions 110 each include an enlarged end portion 58 that defines a radially inwardly extending projection 62. The end portions 58 and projections 62 of the drum gear flange 34*d* function similar to those described with respect to the drum gear flange 34*a*, and provide a snap fit engagement for the ball portion 30 of the drive shaft 10.

Figure 10:
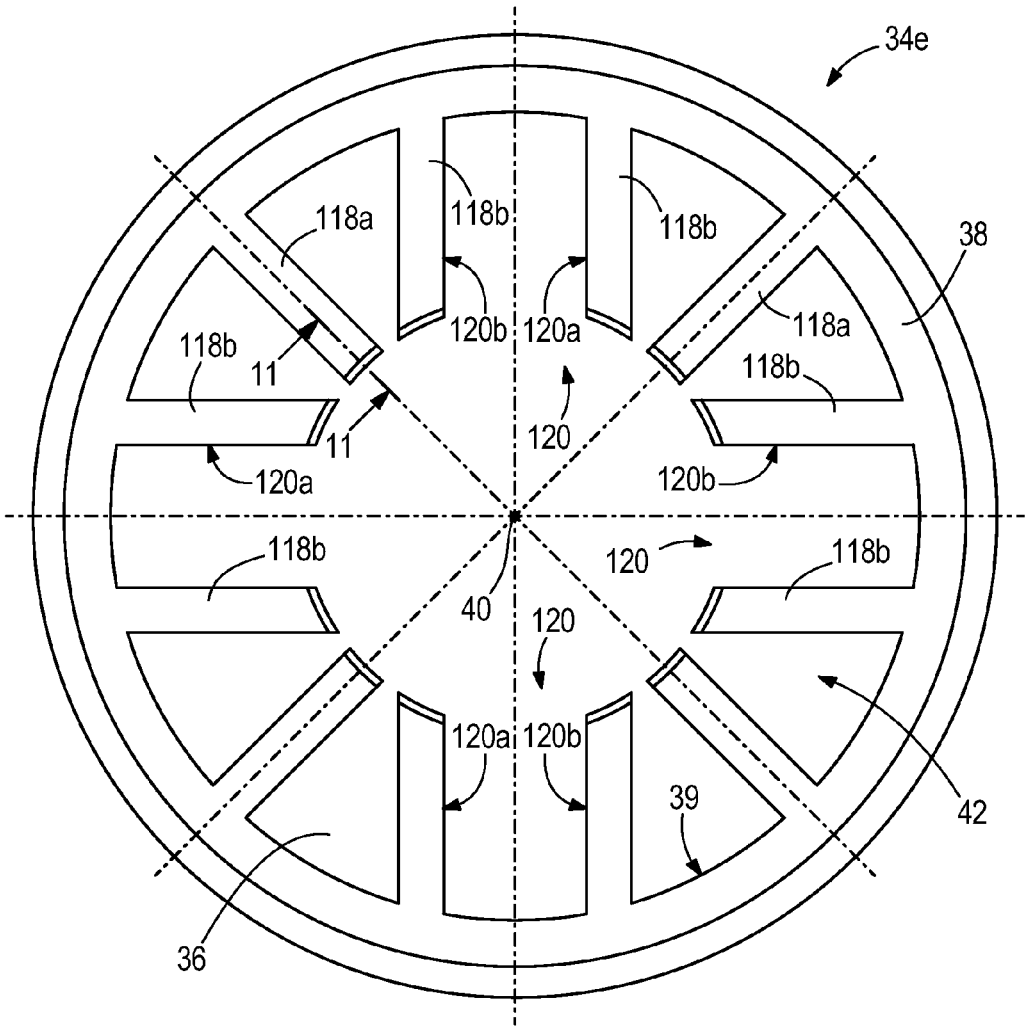
FIG. 10 is an end view of a fifth drum gear flange configured for coupling with the drive shaft of FIG. 1.
Figure 11:
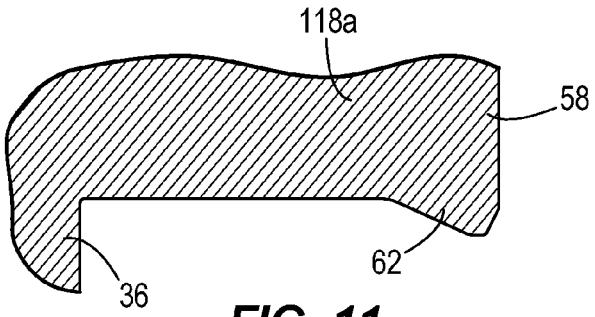
FIG. 11 is a section view taken along line 11-11 of FIG. 2.

Referring also to FIGS. 10 and 11, the drum gear flange 34*e* includes an alternative interior engagement configuration defined by a plurality of first walls 118*a* that are substantially aligned in the radial direction with respect to the central axis 40, and a plurality of second walls 118*b* that extend generally in a radial direction but that are offset from the radial direction with respect to the central axis 40. The second walls 118*b* are arranged in substantially parallel pairs and each pair of second walls 118*b* defines a channel 120 for receiving one end of the pin member 32. One of the second walls 118*b* in each pair defines a substantially flat first engagement surface 120*a* and the other of the second walls 118*b* in each pair defines a substantially flat second engagement surface 120*b*. During rotation of the drum gear flange 34*e* in the clockwise direction, the pin member 32 engages the first engagement surfaces 120*a*, and during rotation of the drum gear flange 34*e* in the counter-clockwise direction, the pin member 32 engages the second engagement surfaces 120*b*. As shown in FIG. 11, the first walls 118*a* and also the second walls 118*b* each include an enlarged end portion 58 that defines a radially inwardly extending projection 62. The end portions 58 and projections 62 of the drum gear flange 34*e* function similar to those described with respect to the drum gear flange 34*a*, and provide a snap fit engagement for the ball portion 30 of the drive shaft 10.

Each of the foregoing drum gear flanges 34*a*, 34*b*, 34*c*, 34*d*, 34*e* is configured to receive driving rotational force from the force transmitting end 26 of the drive shaft 10. Each drum gear flange 34*a*, 34*b*, 34*c*, 34*d*, 34*e* includes an interior engagement configuration comprising walls. Some walls include portions defining an engagement surface that receives driving rotational force from the pin member 32 of the force transmitting end 26, and some walls include portions having radially inwardly extending projections that provide a snap fit engagement for the ball portion of the force transmitting end 26. While some drum gear flanges are configured to receive driving rotational force for rotation primarily in one direction, others are configured to receive driving rotational force in either direction. The drum gear flanges 34*a*, 34*b*, 34*c*, 34*d*, 34*e* are well suited for use in the repair and remanufacturing of toner drums and toner cartridges for use in electrophotographic image forming apparatus. However, the drum gear flanges and the various interior engagement configurations may also be utilized in other applications in which a driving rotational force is provided by a ball member having a pin extending therethrough.

While specific embodiments have been illustrated and described, numerous modifications come to mind without significantly departing from the spirit of the disclosure, and the scope of protection is to be limited only by the scope of the accompanying claims.

What is claimed is:

1. A toner drum gear flange socket adapted for engagement with a force transmitting end of a drive shaft associated with an electrophotographic image forming apparatus, the socket comprising:

a bottom wall;

an outer cylindrical wall including an inner surface and defining a central axis, the outer cylindrical wall extending axially from the bottom wall and cooperating therewith to define a flange cavity;

a plurality of circumferentially spaced apart curved base wall portions extending axially from the bottom wall, each base wall portion having the central axis as its axis of curvature, and including an enlarged end portion that defines a radially inwardly extending projection; and a plurality of substantially straight leg wall portions extending axially from the bottom wall, each leg wall portion also extending generally radially from one end of a respective one of the curved base wall portions and defining an elongated contact surface for receiving driving rotational force from the force transmitting end of the drive shaft.

2. The socket of claim 1, wherein a radially outer end of each leg wall portion is inwardly spaced from the inner surface of the outer cylindrical wall.

3. The socket of claim 1, wherein a respective leg wall portion is positioned at each end of each base wall portion.

4. The socket of claim 3, wherein the leg wall portions and the base wall portions are arranged to define a plurality of circumferentially spaced apart and substantially U-shaped walls, each U-shaped wall including one of the base wall portions and two of the leg wall portions.

5. The socket of claim 4, wherein a radially outer end of each leg wall portion is inwardly spaced from the inner surface of the outer cylindrical wall.

6. The socket of claim 4, wherein the substantially U-shaped walls are arranged in substantially diametrically opposed pairs.

7. The socket of claim 1, wherein the leg wall portions and the base wall portions are connected to the outer cylindrical wall exclusively by way of the bottom wall.

8. A toner drum gear flange socket adapted for engagement with a force transmitting end of a drive shaft associated with an electrophotographic image forming apparatus, the socket comprising:

a bottom wall;

an outer cylindrical wall including an inner surface and defining a central axis, the outer cylindrical wall extending axially from the bottom wall and cooperating therewith to define a flange cavity;

a plurality of circumferentially spaced apart curved base wall portions extending axially from the bottom wall, each base wall portion having the central axis as its axis of curvature, and including an enlarged end portion that defines a radially inwardly extending projection.

9. The socket of claim 8, wherein the base wall portions comprise inner arcuate walls, the socket further comprising a plurality of outer arcuate walls positioned between the base wall portions and the outer cylindrical wall.

10. The socket of claim 9, wherein each outer arcuate wall is substantially radially aligned with a respective one of the inner arcuate walls to define an arcuate wall pair.

11. The socket of claim 10, wherein the inner arcuate wall and the outer arcuate wall of each arcuate wall pair include substantially parallel end surfaces that cooperate to define an engagement surface for receiving driving rotational force from the force transmitting end of the drive shaft.

12. The socket of claim 9, wherein each outer arcuate wall has the central axis as its axis of curvature.

13. The socket of claim 9, wherein the inner arcuate walls and the outer arcuate walls are connected to the outer cylindrical wall exclusively by way of the bottom wall.

14. The socket of claim 8, wherein the inner arcuate walls are connected to the outer cylindrical wall exclusively by way of the bottom wall.

* * * * *